US005287915A

United States Patent [19]

Liu et al.

[11] Patent Number: 5,287,915

[45] Date of Patent: Feb. 22, 1994

[54] HEAT EXCHANGER AND METHOD FOR REMOVING DEPOSITS FROM INNER SURFACES THEREOF

[75] Inventors: Chih-Hsiung F. Liu; Lloyd A. Clomburg, Jr., both of Houston; Otto E. Crenwelge, Jr., Katy; William G. Gottenberg, Houston, all of Tex.; Charles V. Sternling, North Kingstown, R.I.

[73] Assignee: Shell Oil Company, Houston, Tex.

[21] Appl. No.: 901,043

[22] Filed: Jun. 19, 1992

Related U.S. Application Data

[63] Continuation of Ser. No. 633,891, Dec. 26, 1990, abandoned.

[51] Int. Cl.[5] ..... F28G 7/00

[52] U.S. Cl. ..... 165/84; 165/95; 122/379; 208/48 R

[58] Field of Search ..... 165/84, 95; 122/379; 208/48 Q:48 R

[56] References Cited

U.S. PATENT DOCUMENTS

| | | | |
|---|---|---|---|
| 1,548,781 | 8/1925 | Jones | 165/84 |
| 2,366,521 | 1/1945 | Guichet | 208/48 R |
| 2,978,378 | 5/1961 | Hult et al. . | |
| 3,888,302 | 6/1975 | Rounds . | |
| 4,127,473 | 11/1978 | Houzuma et al. | 208/130 |
| 4,243,633 | 1/1981 | Hozuma et al. | 422/129 |
| 4,297,147 | 10/1981 | Nunciato et al. . | |
| 4,461,651 | 7/1984 | Hall . | |
| 4,841,917 | 6/1989 | Premel | 165/84 |
| 4,920,926 | 5/1990 | Linke et al. | 165/84 |

*Primary Examiner*—Albert W. Davis, Jr.

[57] ABSTRACT

Hot fluids are cooled in a heat exchanger which comprises a housing providing a passage for the hot fluid, and heat exchange surfaces arranged within the housing which surfaces provide a passage for a coolant to and from the housing such that there is no direct contact between the hot fluid and the coolant, and which surfaces are movable within the housing. The heat exchanger is very suitable for cooling synthesis gas obtained in the gasification of coal.

10 Claims, 1 Drawing Sheet

HEAT EXCHANGER AND METHOD FOR REMOVING DEPOSITS FROM INNER SURFACES THEREOF

This is a continuation of application Ser. No. 633,891, filed Dec. 26, 1990 now abandoned.

FIELD OF THE INVENTION

The present invention relates to a heat exchanger for cooling hot fluids, such as hot synthesis gas obtained by the gasification of coal, i.e. a gas predominantly consisting of hydrogen and carbon monoxide. Hot fluids may contain contaminants in liquid or solid state. When such hot fluids are passed through a heat exchanger the contaminants may build up deposits on the inner surfaces of the heat exchanger. Synthesis gas obtained from coal gasification, may contain liquid fly slag droplets which in the course of cooling off solidify. In an intermediate stage between being completely liquid and completely solid the fly slag particles tend to be sticky so that they may easily form a build-up of deposits onto such inner surfaces.

The present invention relates to the provision of a heat exchanger that is suitable for cooling hot fluids, such as synthesis gas, and that allows for an easy removal of any deposits that may have built up on the inner surfaces thereof.

BACKGROUND OF THE INVENTION

The problem of deposit build-up in heat exchangers has been known for a long time and several solutions for this problem have been suggested.

In U.S. Pat. No. 2,978,378 a method for cleaning heat exchanger surfaces is described in which steel shot is scattered and allowed to drop against the inner surfaces of the heat exchanger so that deposits thereon are knocked off. The steel shot is recovered and recycled to the top of the heat exchanger.

U.S. Pat. No. 4,297,147 discloses a method for decoking fired heater tubes by stopping the normal operation of the heater and introducing a gas laden with steel shot into the inlet of the tubes at a certain velocity. A main disadvantage of this method resides in the requirement that the normal operation of the apparatus in question needs to be stopped. In U.S. Pat. No. 4,243,633 a reactor for the thermal cracking of a heavy oil is described which reactor is provided with a rotatable injection tube containing several nozzles which allow for the spraying of fluid against the inner wall of the reactor to remove deposits, such as coke.

From U.S. Pat. No. 3,888,302 a method for cleaning interior surfaces of a heat exchanger is known in which the normal operation of the heat exchanger can be continued during such cleaning. In this method a compound is added to the fluid to be cooled, which compound reacts with the deposits to render them volatile or friable. Evidently, such a method can only be used when deposits can react with such compounds and when the compound in question does not have any detrimental effect on any subsequent operation of the fluid, or, if the fluid is discharged, on the environment.

U.S. Pat. No. 4,461,651 describes a device for cleaning heat exchanger surfaces from deposits, which device employs sound energy vibration. The sound that is produced by the device procures vibrations to the particles in the deposits so that they fluidize. The device is to be constructed such that the distance between the surface to be cleaned and the device is between 10 and 15 feet.

It is an object of the present invention to provide a simple solution for the problem of cleaning inner surfaces of a heat exchanger while the normal operation of the heat exchanger may be continued and without the necessity to add alien compounds to the hot fluid.

SUMMARY OF THE INVENTION

According to the invention there is provided a heat exchanger for cooling a hot fluid, comprising a housing providing a passage for the hot fluid, and heat exchanger surfaces arranged within the housing, which surfaces provide a passage for a coolant from at least one connection for the supply of the coolant from outside the housing to at least one connection for the withdrawal of the coolant outside the housing such that the coolant is not in direct contact with the hot fluid, and which surfaces are movable within the housing.

Since the heat exchanger surfaces are movable, they will start moving when one incurs a shock to them. By such movement deposits that may have built up are knocked off. Therefore. the invention further provides a method for removing deposits from inner surfaces of a heat exchanger comprising a) passing a hot fluid through the housing of the heat exchanger;

b) passing a coolant through a passage provided by movable heat exchange surfaces in the housing without bringing the coolant into direct contact with the hot fluid; and c) causing the heat exchange surfaces to move so that deposits that may have built up on the inner surfaces of the heat exchanger are knocked off.

A suitable way of exciting the tubes to move is to supply continuously or intermittently vibration energy from a shaking device (e.g. electrodynamic, hydraulic, direct-drive mechanical) through a link with the heat exchanger walls. One suitable way of causing such vibration is by using a rapper or a vibrator. Another preferred way is to suddenly change the flow rate of the coolant through the passages provided by the heat exchange surfaces, so that the heat exchange surfaces start to move by the sudden hydraulic impact, in the same manner as in the well-known water-hammer effect.

DETAILED DESCRIPTION OF THE INVENTION

The inner surfaces on which deposits may build up include the inner wall of the housing and the heat exchange surfaces. By rendering the heat exchange surfaces movable and by arranging at least some of the heat exchange surfaces close to the inner wall of the housing, the movement of the heat exchange surfaces may not only knock off any deposits on such surfaces but it may also cause contact between the inner wall of the housing and the heat exchange surfaces so that also deposits from said inner wall are removed.

The heat exchange surfaces may have any suitable shape. Hence it is possible to have heat exchange plates. Preferably the heat exchange surfaces are constituted of a heat exchange tube.

One way of constructing the heat exchange surfaces such that they are movable is by arranging bellows or a sliding joint at suitable locations. One such suitable location is the place at which or in the vicinity of which the heat exchange surface is connected to the inner wall of the housing. Another suitable way to render the heat exchange tube is the form of a coil, in which the loops are not welded together but are loose. By causing a water-hammer effect in such a coil or by vibrating or impacting such coil, the tube starts to move and due to such movement and to any collisions that may take place between the tube loops and between the loops and the inner wall of the housing, an efficient way of removing deposits is attained.

To facilitate the impact of a shock or vibration on the heat exchange surfaces the coil of a heat exchanger tube is suitably interlaced with another heat exchange tube having the shape of a coil. The latter tube may be securely fixed to the inner wall of the heat exchanger housing. Another possibility is to construct this latter tube as loosely as the former coil. By causing a shock or a vibration to at least one of these coils, this one will start to move and will contact the other one so that an improved removal of deposits is obtained.

The coolant to be used in the present invention can be any conventional coolant and is suitably steam or water.

The water-hammer effect is created by a sudden change in the flow rate of the coolant, so that an increase in pressure is obtained which is capable of exciting the heat exchanger surfaces to vibration with a sufficient amplitude for cleaning without causing damage to the heat exchanger itself. The change in velocity ($\Delta v$) required to achieve the desired change in pressure ($\Delta p$) is given for a liquid as $\Delta v = -\Delta p/(\rho c)$, where $\rho$ is the coolant density and c is the coolant sonic velocity.

Since the heat exchanger according to the present invention advantageously can be employed in cooling hot synthesis gas emanating from the gasification of coal, the present invention further relates to a process for the production of synthesis gas containing carbon monoxide and hydrogen, which process comprises a) subjecting coal to a gasification reaction with oxygen and steam to yield synthesis gas and slag;
b) cooling the synthesis gas entraining fly slag droplets in a heat exchanger by passing said synthesis gas through the housing of the heat exchanger and by passing a coolant through a passage provided by movable heat exchange surfaces in the housing without bringing the coolant into direct contact with the synthesis gas; and
c) causing the movable heat exchange surfaces to move.

The deposits that are removed from the inner surfaces of the heat exchanger may be entrained further by the cooled fluid. It is also possible that they fall under the influence of gravity. To the case of coal gasification the fallen slag particles are preferably taken up in a slag bath and processed further. The movable heat exchanger surfaces may be moved continuously or intermittently.

DETAILED DESCRIPTION OF THE DRAWINGS

Figure 1:
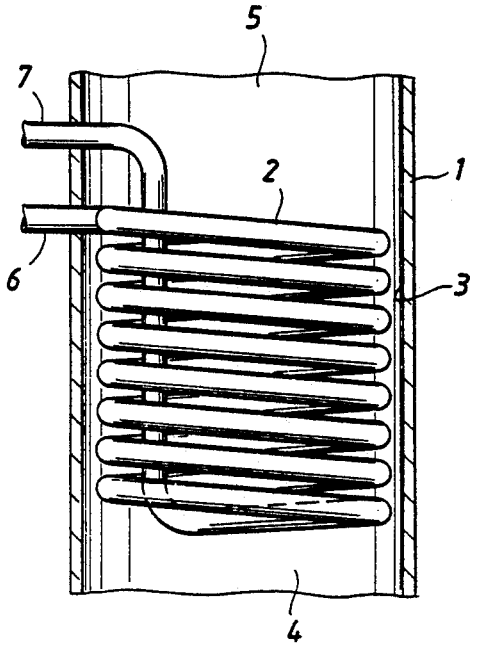
FIG. 1 gives a diagrammatic view of a heat exchanger with a movable coil-type heat exchanger tube.

FIG. 1 shows a heat exchanger housing 1 in which a heat exchanger tube 2 has been helically arranged as a coil along a wall 3 of the housing 1. The housing 1 provides a passage for a hot fluid via an inlet orifice 4 and an outlet orifice 5. The tube 2 can be connected to a source of coolant via an outlet connection 7. The tube 2 is only connected to the wall 3 at the spots where the tube penetrates the wall to arrive at the inlet connection 6 and outlet connection 7. The loops of the coil are all loose. By suddenly changing the flow rate of the coolant through tube 2 the loops will start to move and deposits on the tube 2 and the wall 3 will be knocked off.

Figure 2:
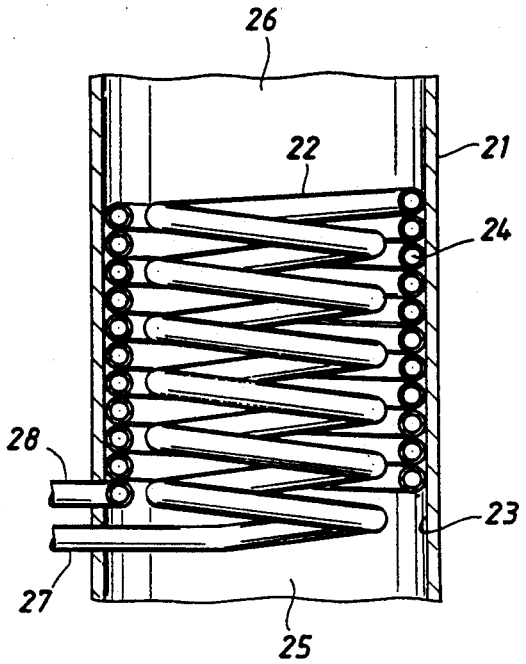
In FIG. 2 another embodiment of such a heat exchanger is depicted.

In FIG. 2 a similar heat exchanger as in FIG. 1 is shown. This heat exchanger is provided with a housing 21, with a wall 23 and a heat exchanger tube 22. The heat exchanger tube 22 has been arranged such that the hot fluid is additionally cooled by a wall of heat exchanger loops 24 through which coolant is passed. In the embodiment shown the loops 24 are part of the heat exchanger tube 22. It is evident that it is also possible to arrange two tubes, one as a wall of loops 24 welded together and one as a loose coil-type heat exchanger tube. From the figure it is apparent that the inlet 25 and outlet orifice 26 for the hot fluid and the inlet connection 27 and outlet connection 28 for the coolant are similarly arranged as in FIG. 1.

Figure 3:
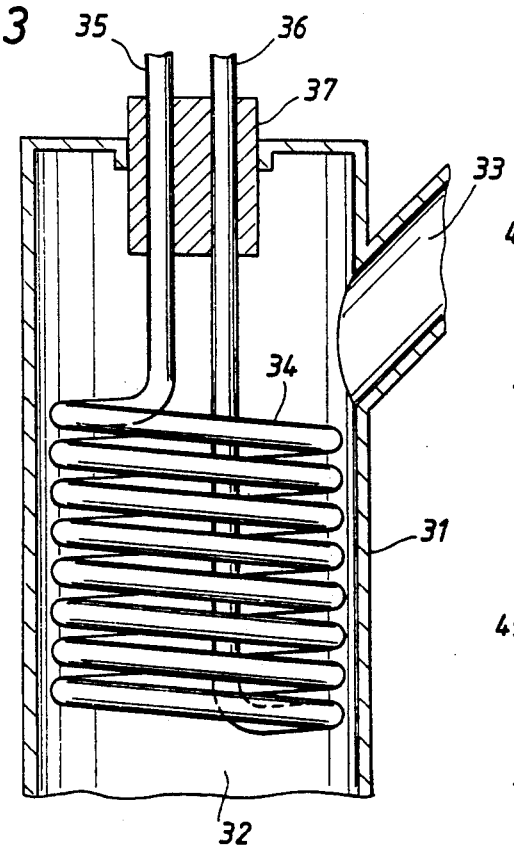
FIG. 3 shows an embodiment of the heat exchanger according to the invention in which the coil-type heat exchanger tube can be moved mechanically.

FIG. 3 shows a heat exchanger housing 31 with an inlet 32 and an outlet 33 for the hot fluid to be cooled. The heat exchanger further comprises a heat exchange tube 34 in the form of a coil with inlet connection 35 and outlet connection 36 for coolant. The heat exchanger is further provided with a sliding packing joint 37 by means of which the heat exchange tube 34 can be moved. A rapper or vibrator can also be used to cause a movement to the heat exchange tube 34.

Figure 4:
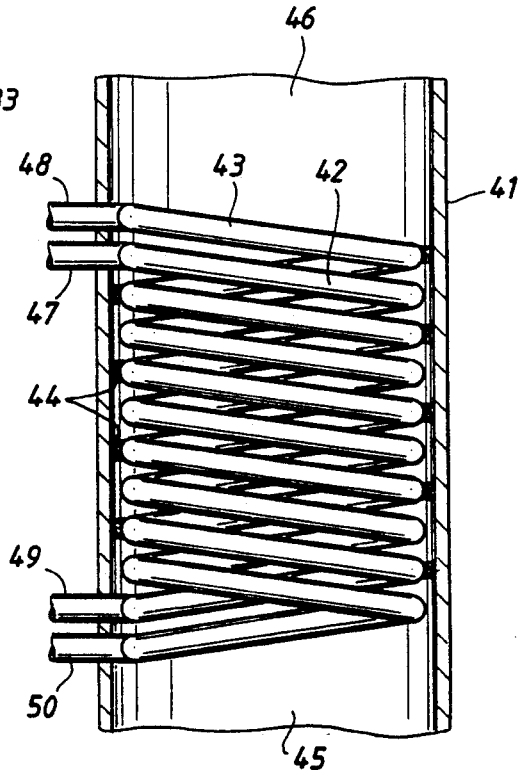
FIG. 4 gives a diagrammatic view of an embodiment of the present heat exchanger in which two coils are interlaced.

FIG. 4 shows a heat exchange housing 41 with a heat exchange tube 42 in the form of a loose coil, together with a heat exchange tube 43 that also has the shape of a coil. However, the loops of the latter tube 43 are welded to the wall of the housing 41 by means of welds 44. The heat exchanger is further provided with an inlet 45 and outlet 46. Coolant is introduced into heat exchange tube 42 via an inlet connection 47 and into heat exchange tube 43 via inlet connection 48. Coolant is withdrawn from the tubes via outlet connections 49 and 50, respectively. Heat exchange tube 42 is constructed such that it can rotate relative to the other.

The embodiments of the figures described above are illustrative to the present invention and are not set forth to have a limiting effect on the claims hereinafter presented.

What is claimed is:

1. A process for the production of synthesis gas containing carbon monoxide and hydrogen, which process comprises:

a) subjecting coal to a gasification reaction with oxygen and steam to yield synthesis gas and slag;
b) cooling the synthesis gas containing fly slag droplets in a heat exchanger by passing said synthesis gas through the housing of the heat exchanger and by passing a coolant through a passage provided by movable heat exchange surfaces in the housing without bringing the coolant into direct contact with the synthesis gas; and c) causing the movable heat exchange surfaces to vibrate, thereby removing slag from the inner wall of the housing and from movable heat exchange surfaces, by suddenly changing the flow rate of the coolant through the passage provided by the movable heat exchange surfaces, and at least some of the movable heat exchange surfaces are close to the inner wall of the housing.

2. The process according to claim 1, in which the movable heat exchange surfaces are caused to vibrate intermittently.

3. The process according to claim 1, in which the heat exchange surfaces are constituted of a heat exchange tube in the form of a loose coil.

4. The process according to claim 3, in which the heat exchange tube in the form of a loose coil is interlaced with a second heat exchange tube, having also the shape of a coil.

5. The process according to claim 4, in which the second heat exchange tube is fixed to the housing of the heat exchanger.

6. A process according to claim 4, in which the second heat exchange tube consists of loose loops.

7. A method for removing deposits from the inner wall of a housing and from movable heat exchange surfaces of a heat exchanger, comprising:

a) passing a hot fluid through the housing of the heat exchanger;

b) passing a coolant through a passage provided by movable heat exchange surfaces in the housing without bringing the coolant into direct contact with the hot fluid;

c) causing the movable heat exchange surfaces to vibrate by suddenly changing the flow rate of the coolant through the passage provided by the movable heat exchange surfaces; and d) causing the heat exchange surfaces that are constructed as a heat exchange tube to be in the form of a loose coil, and at least some of the movable heat exchange surfaces are close to the inner wall of the housing.

8. The method according to claim 7, in which the heat exchange tube in the form of a loose coil is interlaced with a second heat exchange tube, having also the shape of a coil.

9. The method according to claim 8, in which the second heat exchange tube is fixed to the housing of the heat exchanger.

10. The method according to claim 8, in which the second heat exchange tube consists of loose loops.

* * * * *